US007683530B2

(12) United States Patent
Obraztsov

(10) Patent No.: US 7,683,530 B2
(45) Date of Patent: Mar. 23, 2010

(54) CATHODOLUMINESCENT LIGHT SOURCE HAVING AN ELECTRON FIELD EMITTER COATED WITH NANOCARBON FILM MATERIAL

(76) Inventor: Alexandr Nikolaevich Obraztsov, Yaroslavskoye shosse, d.120, korp. 2, kv. 192, Moscow (RU) 129337

( * ) Notice: Subject to any disclaimer, the term of this patent is extended or adjusted under 35 U.S.C. 154(b) by 355 days.

(21) Appl. No.: 10/510,794

(22) PCT Filed: Apr. 17, 2002

(86) PCT No.: PCT/RU02/00175

§ 371 (c)(1),
(2), (4) Date: Apr. 11, 2005

(87) PCT Pub. No.: WO03/088308

PCT Pub. Date: Oct. 23, 2003

(65) Prior Publication Data

US 2005/0174059 A1 Aug. 11, 2005

(51) Int. Cl.
*H01J 1/62* (2006.01)

(52) U.S. Cl. ..... 313/491; 313/495

(58) Field of Classification Search ..... 313/491–497
See application file for complete search history.

(56) References Cited

U.S. PATENT DOCUMENTS

| | | | | |
|---|---|---|---|---|
| 4,757,234 A * | 7/1988 | Ikuta et al. | ..... | 313/496 |
| 6,281,626 B1 * | 8/2001 | Nakamura et al. | ..... | 313/491 |

FOREIGN PATENT DOCUMENTS

| | | | |
|---|---|---|---|
| GB | 517526 | | 2/1940 |
| JP | 61-107653 | | 5/1986 |
| WO | WO9707531 | * | 2/1997 |
| WO | WO 01/09914 A1 | | 2/2001 |

* cited by examiner

*Primary Examiner*—Joseph L Williams
(74) *Attorney, Agent, or Firm*—Merchant & Gould P.C.

(57) ABSTRACT

A cathodoluminescent light source has a field-emission cathode serving as a source of electrons, an anode having a specular light-reflecting surface, and an electron-excited phosphor applied to the specular light-reflecting anode surface. The cathode and anode are enclosed in an evacuated housing having a transparent surface, so as to let the electron-excited phosphor on the anode surface be irradiated with an electron beam, and to let the luminous flux resulting from the process of cathodoluminescence to emerge.

6 Claims, 6 Drawing Sheets

CATHODOLUMINESCENT LIGHT SOURCE HAVING AN ELECTRON FIELD EMITTER COATED WITH NANOCARBON FILM MATERIAL

TECHNICAL FIELD

The present invention relates to sources of optical radiation used for lighting and/or forming images using displays of diverse constructions and purposes.

BACKGROUND ART

A variety of light sources are used virtually in every field of human activity. In an overwhelming majority of instances the operating principle of light sources implies electric current conversion into light. Depending on their specific use, light sources should meet definite requirements as to radiation intensity and directivity, spectral distribution, overall dimensions, and other characteristics. The most important parameter of any light source is the efficiency of electric energy conversion into light. Hence, the parameters of the various light sources may vary within broad ranges depending upon the physical fundamentals used for light emission. In particular, the efficiency of electric energy conversion into visible light in incandescent lamps is as low as 1.5%. The efficiency of electric energy conversion into light sources based on electroluminescence of various kinds depends mainly on the wavelength of the light emitted and varies from 0.015% for a short-wave (blue) spectral range to 15% for a long-wave (red and infrared radiation). In various gas-discharge light-emitting apparatus and devices the energy conversion efficiency varies from 1% to 20% depending on the kind of discharge and spectral characteristics of the radiation. Gas-discharge light sources are utilized in particular as UV radiation sources for further emission of visible light due to photoluminescence. Efficiency of conversion of UV radiation energy into visible light is as high as 60% which brings an energy efficiency (i.e., a total efficiency of electric energy conversion into visible light) in photoluminescent lamps to as high a level as 10%. Despite a relatively high energy efficiency of photoluminescent lamps, they suffer from a number of disadvantages. One of the most substantial disadvantages is the use of mercury therein. Electron beams may be used instead of UV radiation for exciting luminescence. In such a cathodoluminescent process the efficiency of conversion of UV radiation energy into visible light may reach 35-40%. In addition, a total efficiency of cathodoluminescent light sources is a function of the amount of power consumed in establishing the required electron beam.

Serving as exemplary cathodoluminescent light sources are various cathodoluminescent lamps, indicators, TV tubes, vacuum luminescent devices, and the like. As a rule, an electron beam in such devices is established by thermionic emission from a high-temperature cathode (see British patent #2,009,492 and RU patent #2,089,007). Efficiency of electric energy conversion into visible light in such devices is too low due to the fact that a considerable proportion of the energy must be spent on heating the cathode. Furthermore, the fields of application of such devices are severely restricted by complicated production processes, as well as overall dimensions and requirements imposed upon operating conditions of the devices. On the other hand, use of other kinds of stimulated emission of electrons as a source thereof, such as photoemission, secondary electron emission, and the like likewise fail to provide high-efficiency electric energy conversion into light.

An alternative method for producing an electron beam utilizes the effect of field (or spontaneous) emission. Unlike thermionic, photoelectronic, and other kinds of stimulated emission, the field emission of electrons occurs without energy absorption in the material of the cathode (emitter) which establishes a prerequisite for the provision of high-efficiency light sources. However, the provision of electron beams using field-emission cathodes and having a current density high enough for practical use involves a very high electric field intensity (potential gradient) effective on the cathode surface (108-109 V/m). Such high field intensity requires in turn the use of adequately high voltage values and/or of cathodes shaped as thin spires or blades that contribute to a local electric field amplification. Accordingly, voltage values accessible from a practical standpoint involve the provision of spires and blades of micron and sub-micron range, which adds substantially to the cost of their production. Moreover, the electron emission that occurs is extremely unstable due to the high sensitivity of such micron-size spire structures and environmental conditions. These circumstances impede substantially the use of spire-type and blade-type field-emission cathodes in broad-purpose apparatus and devices.

Known in the art presently is a cathodoluminescent light source wherein a fine thread of an electrically conductive material is utilized as a field-emission cathode (see WO97/07531). In a lamp of this type the cathode is enclosed in an evacuated glass bulb whose inside surface has a transparent electrically conductive coating serving as an anode. A layer of a phosphor capable of light emission under the effect of an electron stream is applied to the electrically conductive coating. However, one of the disadvantages inherent in such a construction resides in the fact that in order to provide an adequately high electric field intensity required for electron emission and the values of a voltage between the anode and cathode acceptable for practical use, one is forced to utilize threads having extremely small diameter (from 1μ to 15 μ). The low mechanical strength of such fine threads presents considerable problems in making cathodes for the light sources under consideration. One more disadvantage of this construction of cathodoluminescent lamps lies with the fact that an electron beam performs a most efficient excitation on that side of the electron-excited phosphor layer which faces the cathode, that is, inwards of the glass bulb. Hence a considerable proportion of the luminous flux is absorbed in those electron-excited phosphor layers which are located nearer to the transparent outside bulb surface. Light absorption results in a loss of a part of the energy and affects the general efficiency of lamps of a given type.

Known in the art are carbon materials, wherein field emission is observed to occur at a much lower electric field intensity ($10^6$-$10^7$ V/m) which is due to nanometer dimensions of the structural elements thereof, as well as due to specific electronic properties inherent in nanostructurized carbon (cf. WO 00/40508 A1). Use of such materials as electron emitters (cathodes) enables one to substantially reduce the value of a voltage applied between the anode and cathode to produce an electron beam.

One more cathodoluminescent light source is known to appear as a cylinder-shaped vacuum diode with a field-emission cathode appearing as a dia. 1 mm metal wire provided with carbon nanometer-size tubes (nanotubes) applied to the wire surface (cf. J.-M. Bonard, T. Stoeckli, O. Noury, A. Chatelain, App. Phys. Lett. 78, 2001, 2775-2777). Use of carbon nanotubes makes it possible in this case to reduce the voltage values used in the device. However, one of the disadvantages the lamps of said type suffer from is the use of carbon nanotubes whose production process involves utilization of a metallic catalyst. The nanotubes manufactured by such a process carry metal particles at the end thereof, whereby the tubes want further chemical treatment to remove said particles and attain a required electrode emission efficiency. Another disadvantage inherent in said lamps is the fact that subjected to electron excitation is also an electron-excited phosphor disposed on an inside surface of the cylinder-shaped glass bulb. Part of the light emitted by said layer is absorbed when the light passes towards the transparent lamp surface, thereby affecting adversely a total efficiency of electric energy conversion into light.

DISCLOSURE OF THE INVENTION

It is a principal object of the present invention to provide a cathodoluminescent light source capable of ensuring as high electric energy conversion into light as possible.

Other objects of the invention are a simplified construction and production process techniques of the lamp proposed herein.

Said objects are accomplished by the present invention due to firstly, the fact that the anode surface facing the cathode has a specular light reflecting surface.

In addition, said objects are accomplished also due to a special construction arrangement of the light source used.

In one of the preferred embodiments of the invention the housing of a light source is cylinder-shaped, the specular anode surface overlaps part of the inside surface thereof, whereas the remainder surface of the housing is transparent to the light arising thereinside to pass through. The cathode is shaped as a thread arranged along the longitudinal axis of the housing.

In another preferred embodiment of the present invention the housing is spherical-shaped, the specular anode surface overlaps part of the inside surface of said sphere, and the cathode is shaped as a spire located at the center of the spherical surface of the housing or nearby said center.

In one more preferred embodiment of the present invention the light source is provided with a base enclosed in a transparent housing adapted to be evacuated and provided with either grooves or hemispherical recesses, the surface of both said grooves and recesses being a specular light reflecting one and the grooves and recesses themselves perform the functions of an anode, whereas the cathodes appear either as threads located above said grooves along them, or as spires situated over the centers of the hemispherical recesses.

EMBODIMENTS

Figure 1:
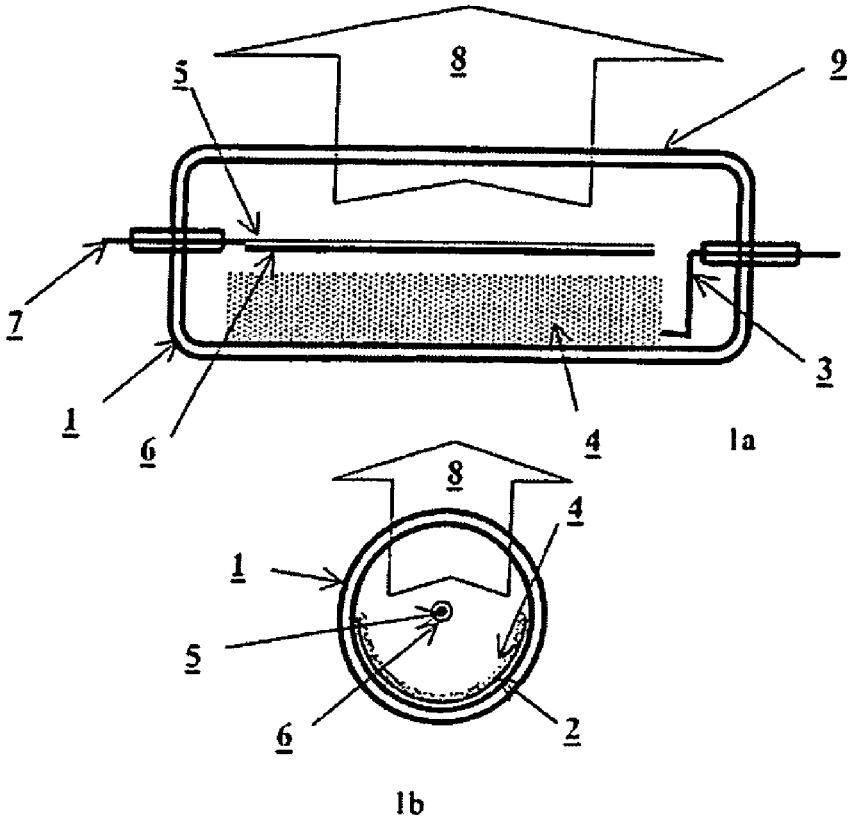
FIG. 1 is a view of an embodiment of a cylinder-shaped lamp, according to the invention (side view (1*a*), end view (1*b*) and perspective view (1*c*)
Figure 1:
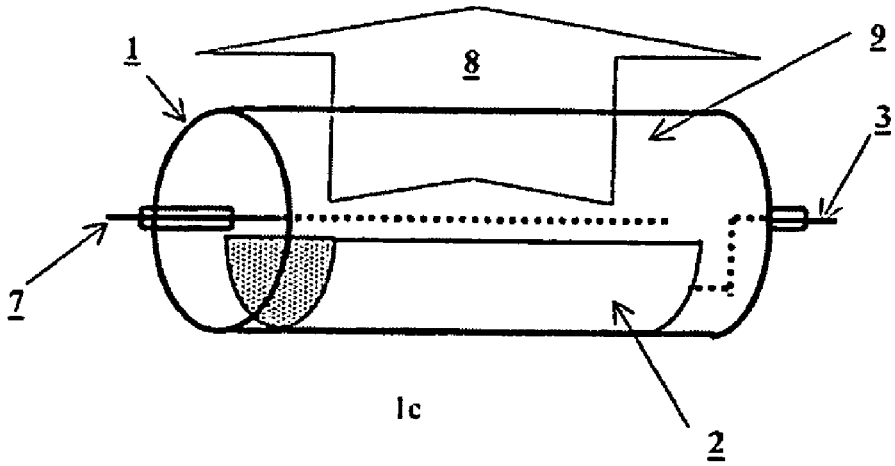

A cathodoluminescent lamp according to the invention may be shaped as a cylinder-shaped vacuum diode schematically shown in FIG. 1. To this end, first a cylinder-shaped glass bulb 1 is prepared, whereupon a layer 2 of aluminum or some other metal featuring good light-reflecting properties is applied to a portion of the inside cylinder-shaped bulb surface. The reflecting metal layer is electrically connected to an electrode that is brought to the outside surface of a bulb 3. A layer 4 of an electron-excited phosphor is applied to the reflecting metal layer 2. The bulb 3 accommodates a field-emission cathode appearing as a cylinder-shaped metal wire 5 coated with a layer of a carbon material 6 featuring high-efficiency field electron emission. It is expedient to use as the carbon material a film consisting of a nanometric-size graphite crystallites and carbon nanotubes as taught in WO00/40508 A1. The cathode is arranged lengthwise along the bulb's longitudinal axis and is electrically connected to an electrode which is brought to the outside surface 7 of the bulb 3. The diameter of the wire that the cathode is made from and that of the cylinder-shaped bulb 3 are so selected as to provide, with the preset operating voltage values applied across the anode and cathode, such a level of electric field intensity effective on the cathode surface that is required for establishing an electron emission current of a required magnitude. For instance, for the aforementioned carbon material, as taught by WO00/40508 A1, a required field intensity (F) equal to or in excess of $1.25\times10^6$V/m may be attained at a voltage (V) equal to or in excess of 4 kV applied across the cathode having a diameter d=1 mm and the anode having a diameter D=20 mm in accordance with a known formula $F=V/[d\ln(D/d)]$. Accordingly, when applying a voltage in excess of 4 kV the electrons emitted from the cathode are accelerated in the interelectrode space to make the electron-excited phosphor applied to the anode surface glow. It is due to the provision of a specular reflecting anode surface that a luminous flux 8 of cathodoluminescence is directed towards a transparent (non-metalized) area of the surface of a glass bulb 9. The lamp may use further electrodes (not shown) aimed at control over the electron beam (that is, focusing, deflection, and modulation). Once all electrodes have been fixed in position inside the lamp, the latter is evacuated to a required level and hermetically sealed. To maintain a required vacuum level in the lamp for a prolonged period of time a getter may be used.

Figure 2:
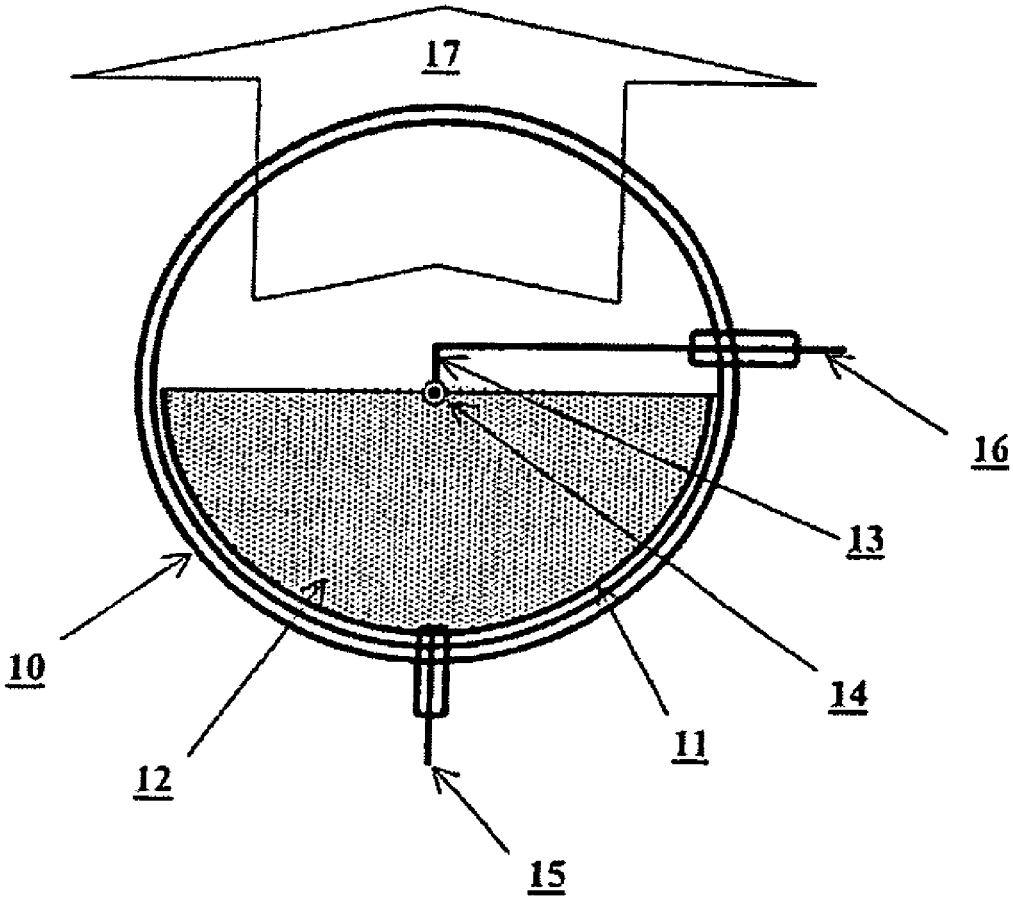
FIG. 2 is a view of an embodiment of a spherical lamp, according to the invention.

The cathodoluminescent lamp according to the invention may appear as a spherical vacuum diode shown schematically in FIG.2. The lamp is made from a spherical-shaped glass bulb 10. Part of the area of the inside bulb surface is provided with a metallic coating 11 serving as the anode. The anode surface is coated with an electron-excited phosphor layer 12. The cathode appears as a spire having a surface 13 close to a spherical one. The cathode surface is coated with a carbon film 14 similar to that mentioned in the preceding example. A spherical cathode portion coated with the carbon film is located at a point disposed substantially at the bulb center. The cathode and anode are electrically connected to the electrodes brought to the outside surface of the glass bulb 15 and 16. Like in the preceding example a luminous flux 17 resulting from cathodoluminescence emerges from the lamp through a portion of its surface remaining non-metalized. In the case of a spherical lamp a formula associating the lamp geometrical characteristics (i.e., cathode diameter d and anode diameter D) with applied voltage (V) and electric field intensity appears as $F=2VD/[d(D-d)]$. According to the formula, the spherical configuration enables a required field intensity to be attained on the cathode surface when using lower field intensity values, or with smaller overall dimensions of the lamp electrodes compared with a cylindrical configuration.

Figure 3:
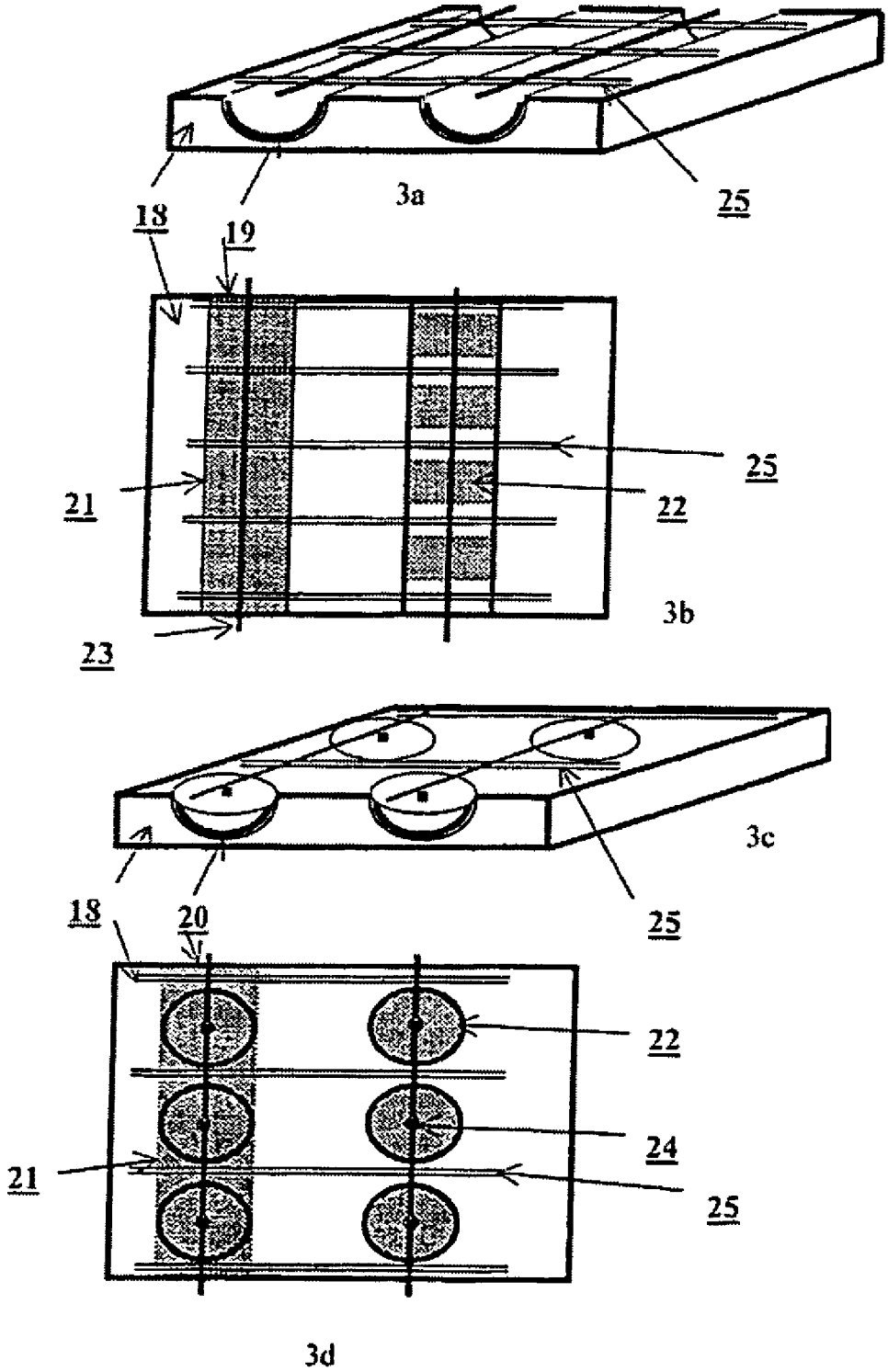
FIG. 3 is a view of an embodiment of a flat lamp, according to the invention, comprising a number of cathodes and anodes, wherein 3*a* and 3*b* show a perspective view and a plan view, respectively, of a lamp with threadlike cathodes, and 3*c* and 3*d* show those of a lamp with spire-shaped cathodes.

The cathodoluminescent lamp according to the invention may also appear as a flat device having a number of cathodes and anodes. FIG. 3 illustrates schematically a light-emitting structural component of a flat lamp, comprising cathodes and anodes. In such a case the lamp anode may appear as a plate 18 having one or more recesses having either cylinder-shaped profile 19 or spherical-shaped profile 20. The plate may be made from an electrically conductive light-reflecting material or from an insulant (e.g., glass) and is then metalized. The metallization layer may be either a continuous one 21 or appear as separate electrically insulated portions 22. The light-reflecting anode surface is coated with a layer of electron-excited phosphor, whereas the cathode, like in the preceding embodiments, appears as electrically conductive threads 23 or spires 24 coated with a carbon layer which provides for the required electron emission characteristics. The threads are situated above the anode plate surface so as to cause cathodoluminescence under the effect of emitted electrons. Glass or quartz fibers 25 may be used for mechanically securing preset spacing from the anode. Cathode threads and threads with spire-shaped cathodes are put a onto the fibers perpendicularly therewith. The emitting and insulating threads may be prefastened together to form a single network. When the latter is the case, such a network from the cathodic and insulating threads is placed onto the anodic plate to form a diode configuration.

Figure 4:
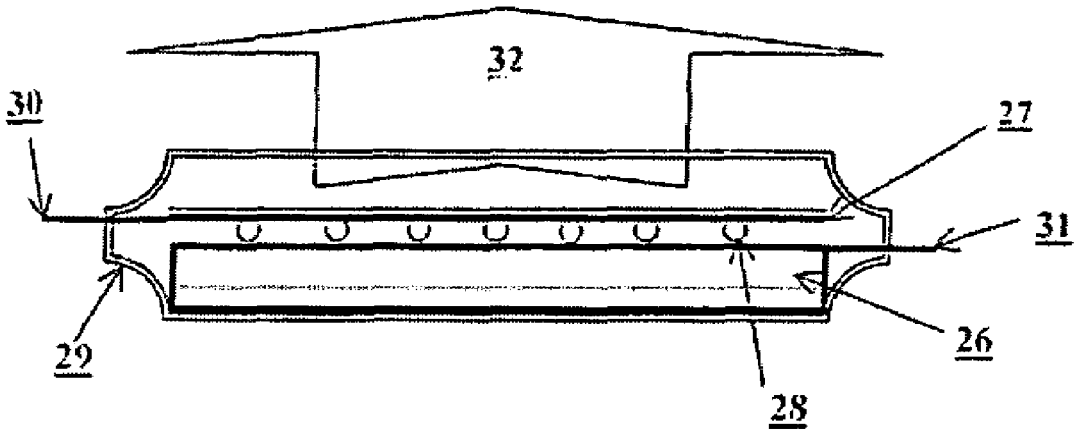
FIG. 4 is same enclosed in a housing.

Once the thread-like cathode has been mechanically held with respect to the anodic plate, the entire structure in an assembled state is enclosed in a hermetically sealed housing having a transparent surface for light to pass through. FIG. 4 shows schematically a flat lamp comprising a light-emitting element provided with anodes 26 and cathodes 27, as well as with dielectric fibers 28 isolating the anodes and cathodes from one another. A hermetically sealed lamp housing 29 comprises electric leads for connecting cathodes 30, anodes 31, and other electrodes, as well as having a transparent window for a luminous flux 32 to emerge.

Figure 5:
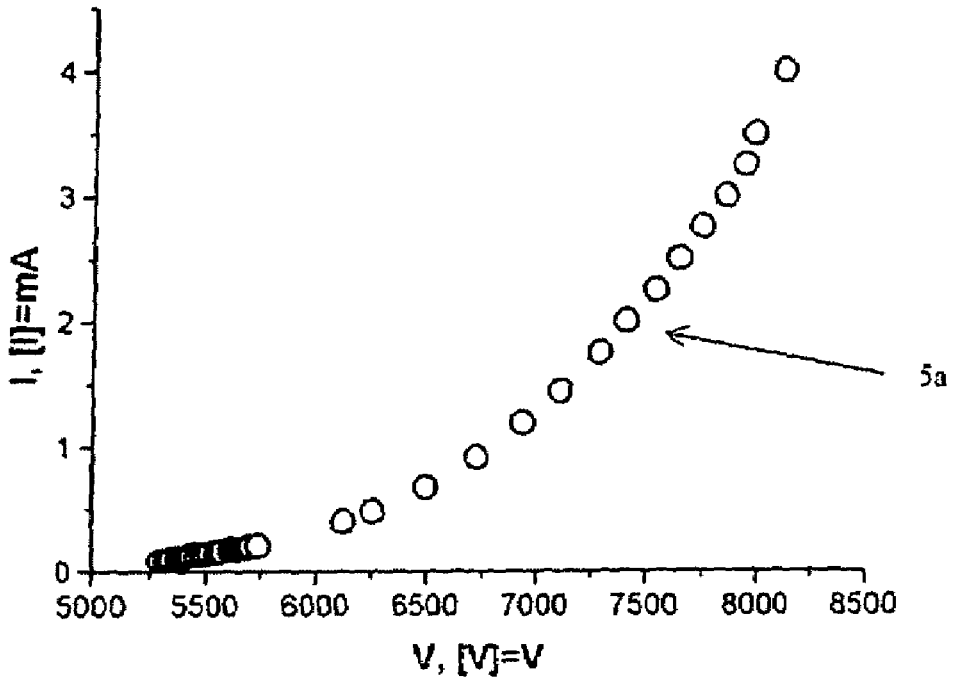
FIG. 5 represents volt-ampere characteristics of a cylinder-shaped lamp made according to the present invention.
Figure 5:
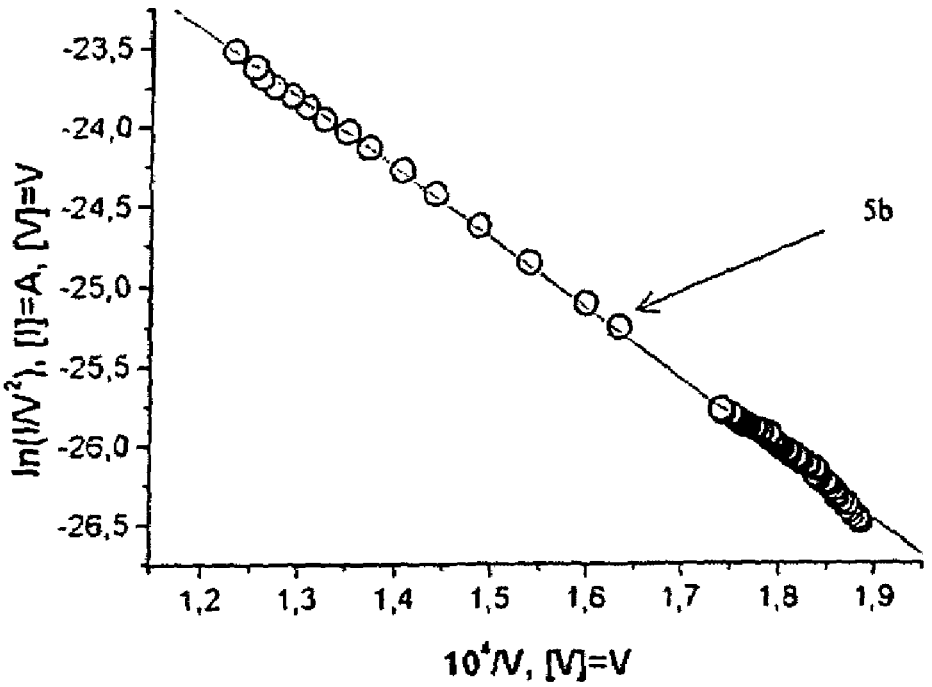

FIG. 5 presents volt-ampere characteristics of a cylinder-shaped lamp made according to the present invention. The lamp cathode in this case is made from 1 mm diameter nickel wire coated with a layer of a carbon electron-emitting material, where the cathode length is 40 mm. The anode appears as a metalized surface of the inner side of a 20 mm diameter glass bulb; the metalized area is 20 mm wide and 40 mm long. The volt-ampere characteristics are presented by a characteristic curve illustrating amperage (I) vs. voltage (V) (FIG. 5*a*) and in the Fowler-Nordheim coordinates (that is, logarithm of the ratio of $I/V^2$ from 1/V) (FIG. 5*b*). In the latter case the relationship has a linear character typical of field electron emission.

Figure 6:
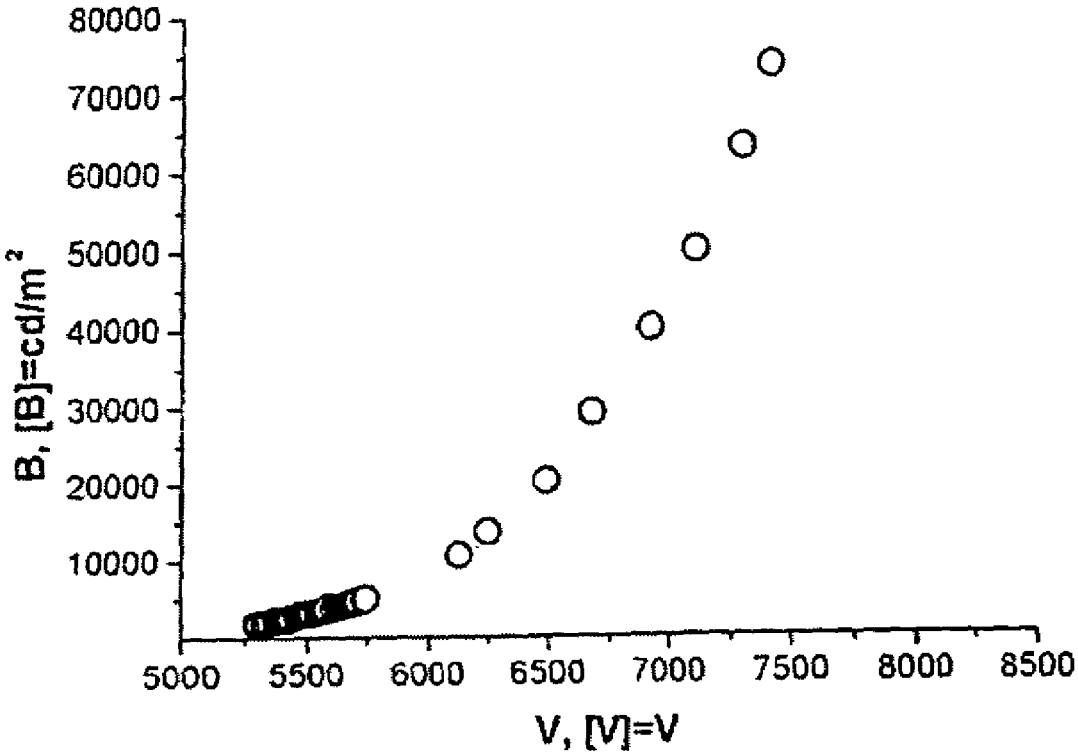
FIG. 6 represents a relationship of luminance vs voltage for a lamp made according to the present invention.

FIG. 6 displays a relationship of lamp luminance (B) vs voltage (V) applied across the anode and cathode. Said relationship refers to the case of a lamp using an electron-excited phosphor having chemical composition of $Gd_2O_2S$:Tb (available from NICHIA Corp.).

Practical evaluation carried out against the data presented in FIGS. 5 and 6 demonstrates that the lamps made according to the present invention feature an efficiency of electric energy conversion into light as high as 30% which exceeds the efficiency of all light sources known to date.

INDUSTRIAL APPLICABILITY

The cathodoluminescent light sources proposed in the present invention are a novel type of light-emitting devices (lamps). Construction of lamps made in accordance with the present invention attain much higher efficiency of electric energy conversion into light compared with other known types of light sources. Lamps of the described type find application in diverse purposes as substitutes for heretofore-known light sources. Lamps of the described type offer substantial advantages over heretofore-known light sources whenever high illuminance is required with a minimum release of heat. Neither construction of the lamps under consideration, nor production process techniques thereof, involve the use of noxious or ecologically harmful materials. By appropriately selected electron-excited phosphor the lamps of the described type may produce light having preset spectral characteristics alongside with high energy efficiency. Lamps of the construction described herein may be used for liquid-crystal displays and for indicators that provide lower power consumption and adequate luminosity. And finally, the lamps described herein having electrically insulated anodes may serve as displays, indicators, and similar apparatus for presenting visual information.

The invention claimed is:

1. A light source comprising:

at least one cathode producing an electron beam as a result of a field emission from a film material covering a surface of said at least one cathode;

at least one anode having a surface facing said at least one cathode that is adapted to perform specular light reflection and is coated with a layer of electron-excited phosphor; and a housing accommodating said at least one anode and said at least one cathode and adapted to be evacuated, wherein at least part of a surface area of said housing opposite said surface facing said at least one cathode is transparent.

2. The light source of claim 1, wherein said housing is cylinder-shaped, said at least one cathode is filiform and is arranged substantially along a longitudinal housing axis, said specular reflecting anode surface overlaps partially an inside cylinder-shaped housing surface, while a remainder portion of said surface area of said housing is transparent to said light generated inside said housing.

3. The light source of claim 1, wherein said housing is spherical-shaped, said at least one cathode is spire-shaped and is arranged substantially at a center of said spherical-shaped housing, said specular reflecting anode surface overlaps partially an inside spherical-shaped housing surface, while a remainder portion of said surface area of said housing is transparent to said light generated inside said housing.

4. The light source of claim 1, wherein said anode surface is formed by applying an electrically conductive coating to a portion of an inside surface of said housing.

5. The light source of claim 1, wherein the light source is provided with a plurality of anodes having a shape approximating to a semi-cylindrical shape and located on a substantially planar base or made therein, and said at least one cathode is thread-like, wherein said threads are disposed above and along said at least one anode.

6. The light source of claim 1, wherein the light source is provided with a plurality of anodes having a shape approximating to a hemispherical shape and located on a substantially planar base or made therein, and said at least one cathode is spire-shaped, wherein said spires are disposed above said at least one anode essentially at a center thereof.

* * * * *